US010723095B2

(12) United States Patent
Kosse

(10) Patent No.: US 10,723,095 B2
(45) **Date of Patent: *Jul. 28, 2020**

(54) PRESS DRIVE DEVICE FOR A PRESS, AND PRESS COMPRISING A PRESS DRIVE DEVICE

(71) Applicant: Schuler Pressen GmbH, Göppingen (DE)

(72) Inventor: Marcus Kosse, Heiningen (DE)

(73) Assignee: Schuler Pressen GmbH, Göppingen (DE)

( * ) Notice: Subject to any disclaimer, the term of this patent is extended or adjusted under 35 U.S.C. 154(b) by 392 days.

This patent is subject to a terminal disclaimer.

(21) Appl. No.: 15/520,654

(22) PCT Filed: Oct. 8, 2015

(86) PCT No.: PCT/EP2015/073237

§ 371 (c)(1),
(2) Date: Apr. 20, 2017

(87) PCT Pub. No.: WO2016/062545

PCT Pub. Date: Apr. 28, 2016

(65) Prior Publication Data

US 2017/0305094 A1 Oct. 26, 2017

(30) Foreign Application Priority Data

Oct. 20, 2014 (DE) ..... 10 2014 115 240

(51) Int. Cl.
*B30B 1/14* (2006.01)
*B30B 1/26* (2006.01)

(52) U.S. Cl.
CPC ..... *B30B 1/14* (2013.01); *B30B 1/266* (2013.01)

(58) Field of Classification Search
CPC ... B30B 1/14; B30B 1/266; B30B 1/26; B21J 9/18; B21J 9/10; B21J 9/12; B21J 9/14; Y10T 74/18248; Y10T 74/18208
(Continued)

(56) References Cited

U.S. PATENT DOCUMENTS 4,689,527 A 8/1987 Wu
6,012,322 A 1/2000 Itakura
(Continued)

FOREIGN PATENT DOCUMENTS

CN 1167678 A 12/1997
CN 1230485 A 10/1999
(Continued)

OTHER PUBLICATIONS

Chinese Office Action dated Jun. 8, 2018, for Chinese Application No. 201580056723.6 with English Translation (16 pgs.).
(Continued)

*Primary Examiner* — Adam J Eiseman
*Assistant Examiner* — Matthew Kresse
(74) *Attorney, Agent, or Firm* — Fitch, Even, Tabin & Flannery LLP

(57) ABSTRACT

A press drive device includes a connecting rod with input and output ends. A drive shaft mounts to rotate about a shaft axis and includes a connecting rod bearing in eccentric relation to the shaft axis. The input end mounts on the connecting rod bearing. At least first and second drive housings are provided on axially opposite sides of the connecting rod bearing. The drive shaft projects into both drive housings. A motor mounts in at least one of the drive housings and includes a stator rotationally fixed to a drive housing peripheral wall located coaxially around the shaft axis. A rotor supported by a rotor hub is arranged radially
(Continued)

within the stator with mounting space between the shaft axis and the rotor for possibly mounting a braking device.

16 Claims, 9 Drawing Sheets

(58) Field of Classification Search
USPC ..... 100/282; 72/443, 449, 450, 451, 452.5, 72/455, 452.2; 74/49; 464/177
See application file for complete search history.

(56) References Cited

U.S. PATENT DOCUMENTS

| | | | | |
|---|---|---|---|---|
| 6,857,784 | B2 * | 2/2005 | DeWachter | F16C 19/385 384/551 |
| 7,475,584 | B2 | 1/2009 | Naito et al. | |
| 8,505,449 | B2 * | 8/2013 | Lauke | B21J 9/18 100/282 |
| 9,713,835 | B2 | 7/2017 | Gebhard et al. | |
| 2006/0055269 | A1 | 3/2006 | Naito et al. | |
| 2011/0083568 | A1 * | 4/2011 | Fahrenbach | B30B 1/266 100/214 |
| 2011/0126649 | A1 | 6/2011 | Darr | |
| 2013/0180301 | A1 | 7/2013 | Schoellhammer | |
| 2014/0056670 | A1 | 2/2014 | Gebhard | |
| 2017/0305094 | A1 | 10/2017 | Kosse | |
| 2017/0313011 | A1 | 11/2017 | Kosse | |

FOREIGN PATENT DOCUMENTS

| | | | | | |
|---|---|---|---|---|---|
| CN | 102582099 | A | | 7/2012 | |
| CN | 202293398 | U | | 7/2012 | |
| CN | 203046275 | U | | 7/2013 | |
| CN | 103302884 | A | | 9/2013 | |
| CN | 103547392 | A | | 1/2014 | |
| CN | 203460455 | U | | 3/2014 | |
| CN | 203567198 | U | | 4/2014 | |
| CN | 104001846 | A | | 8/2014 | |
| DE | 102008034971 | A1 | | 1/2010 | |
| DE | 102008063473 | A1 | | 7/2010 | |
| DE | 102009032231 | A1 | | 1/2011 | |
| DE | 102010031100 | A1 | | 2/2011 | |
| DE | 102011113624 | A1 | | 3/2013 | |
| EP | 1541330 | A1 | | 6/2005 | |
| JP | 61276797 | A | * | 12/1986 | B30B 1/266 |
| JP | S61276797 | A | | 12/1986 | |
| JP | S61277342 | A | | 12/1986 | |
| JP | 2010188392 | A | | 9/2010 | |
| KR | 10-2012-0069968 | A | | 6/2012 | |
| WO | 0159914 | A1 | | 8/2001 | |
| WO | 2009156199 | A1 | | 12/2009 | |
| WO | 2011012290 | A1 | | 2/2011 | |
| WO | 2012022720 | A1 | | 2/2012 | |

OTHER PUBLICATIONS

International Search Report in corresponding International Application No. PCT/EP2015/073237, dated Feb. 8, 2016, 11 pages.
German Office Action in corresponding German Application No. 10 2014 115 240.9, dated Jul. 20, 2015, 10 pages.
Chinese Office Action and Search Report dated Jul. 23, 2018, in corresponding Chinese Application No. 201580056714.7, with English translation (19 pages).
International Search Report dated Dec. 21, 2015, in corresponding International Application No. PCT/EP2015/073234 (10 pages).
German Office Action dated Jul. 16, 2015, in corresponding German Application No. 10 2014 115 238.7 (14 pages).

* cited by examiner

PRESS DRIVE DEVICE FOR A PRESS, AND PRESS COMPRISING A PRESS DRIVE DEVICE

CROSS REFERENCE TO RELATED APPLICATIONS

This patent application is the national phase of PCT/EP2015/073237 filed Oct. 8, 2015, which claims the benefit of German Patent Application No. 10 2014 115 240.9 filed Oct. 20, 2014.

TECHNICAL FIELD

The invention relates to a press drive device for a press that is disposed for driving a slide of the press. Furthermore, the invention relates to a press comprising such a press drive device.

BACKGROUND

Press drive devices for driving a press slide have been known in many different modifications. The use of electric motors or servomotors in the press drive device has already been suggested many times. For example, publication DE 10 2008 034 971 A1 describes a press comprising several direct-drive modules, each acting on a pressure point of the slide. A servomotor can be used in the direct-drive module. The servomotors of different direct-drive modules can either be mechanically coupled or electronically synchronized. In electronic synchronization with four pressure points, the slide can be rotated or tilted about two axes that are perpendicular to each other.

Publication DE 10 2008 063 473 A1 suggests a press drive that can be set up modularly. An electric driving motor, for example a servomotor or a torque motor, may be arranged in a transmission module at a press interface. Furthermore, a brake may be present in the motor module. The motor can be connected to the press via a transmission module comprising an appropriate interface.

Another modular drive system for a press has been known from publication DE 10 2011 113 624 A1. A crankshaft is supported via a radial bearing in a drive housing. The drive is flange-mounted on the side of the drive housing. A connecting rod is mounted to a connecting rod bearing of the crankshaft, said connecting rod converting the rotary motion of the crankshaft into an oscillating motion. A braking device and a planetary gear may be interposed between the drive and the drive housing. The brake and the drive may also be connected to the transmission on opposite sides. Due to the modular design, various installation options are provided.

SUMMARY

In conventional presses the required mounting space for the press drive device is frequently considerable. Therefore, the object of the present invention may be viewed as the provision of a press drive device or a press that allows a more compact design.

The press drive device comprises a connecting rod that has a driving end and a driven end. The driven end is preferably coupled with the slide via a toggle lever linkage. Furthermore, the press drive device comprises a drive shaft, for example a crankshaft or an eccentric shaft. The drive shaft is supported so as to be rotatable about a shaft axis. Opposite the shaft axis, it comprises an eccentrically arranged connecting rod bearing. The driving end of the connecting rod is supported on the connecting rod bearing.

The press drive device comprises at least one electric driving motor, in particular a torque motor, with a stator and a rotor. A "torque motor" is understood to mean a servomotor that is designed for high torques at low rates of revolution. The torque motor has a high number of pole pairs. The diameter of a torque motor is preferably clearly greater than its axial dimension. The torque motor requires only a small mounting space in axial direction.

There are provided at least one first and one second drive housing. In addition to the first and the second housings, it is possible to provide additional drive housings, for example a third or fourth drive housing. The number of drive housings can thus also be greater than two. Each drive housing has a peripheral wall that is closed in itself in the form of a ring and extends in peripheral direction about the shaft axis and/or coaxially with respect to the shaft axis. At least the first and the second drive housings have also preferably one inside wall each. The inside wall is connected to the peripheral wall on the axial side that faces the connecting rod bearing and can be referred to as the interior of the first and the second drive housings, respectively. The drive housing thus has the shape of a pot. The inside wall has an opening in the region of the shaft axis. The first drive housing and the second drive housing are arranged on the axially opposite sides of the connecting rod bearing. Preferably, the drive shaft extends into the first and the second drive housings.

In one or more of the provided drive housings, there is arranged respectively one driving motor comprising a stator and a hollow cylindrical rotor. The housing interior provides a mounting space for the driving motor. In particular, the stator is arranged on the inside surface of the peripheral wall associated with the shaft axis. The rotor may bear permanent magnets on its side facing the stator.

The rotor is supported by a rotor hub. The rotor is connected to the rotor hub in a rotationally fixed manner. The rotor, or at least parts thereof, and the rotor hub may also be designed as an integral part—without seams and joints. The rotor hub, in turn, is coupled to the drive shaft in a rotationally fixed manner. A rotation of the rotor thus causes a rotation of the rotor hub. This connection preferably is without gearing and without any step-up or step-down gear. The rotation of the rotor by a specific angle of rotation about the shaft axis thus causes the rotation of the rotor hub and the drive shaft by the same angle of rotation.

Radially between the shaft axis and the rotor and radially adjacent to the rotor hub the arrangement forms a mounting space that is disposed for installing a braking device in the respective drive housing.

As a result of the inventive design of the press drive device, it is possible to arrange a driving motor and/or a braking device in the manner of a module in a drive housing. Therefore, the press drive device can be flexibly adapted to the press. Furthermore, the mounting space is very small. Consequently, it is possible to implement a compact press, wherein the shaft axis of the at least one drive shaft is oriented in the direction in which the workpiece transport also occurs. In doing so, the press drive device preferably does not extend beyond the outside contour of the press frame of the press. As a result, the accessibility to the front side and the rear side of the press is considerably improved in view of the workpiece transport and/or the replacement of the press tool.

The rotor and/or the rotor hub and/or other components that are connected to the drive shaft in a rotationally fixed manner may act—by increasing their weight and/or by installing at least one gyrating mass element—as a gyrating mass. The free mounting space available in the housing interior may be used to provide such an additional gyrating mass. The additional mass must be arranged so as to be without unbalance.

It is advantageous if each of the first and the second drive housings has a mounting flange for mounting to a press frame. Preferably, the mounting flange is arranged on the axial end of the peripheral wall opposite the inside wall. The mounting flange may be configured as a ring flange. Preferably, the first and the second drive housings are mounted to two opposite plates or cheeks of the press frame in such a manner that only the ring flange and the mounting screws project from the intermediate space that is defined by the two plates or cheeks of the press frame.

An optionally existing third drive housing may be mounted, by means of a connecting flange, to the mounting flange of the first or second drive housing. In this manner, it is possible—in principle—to arrange as many drive housings axially next to each other as desired and to connect them with the first and/or the second drive housing.

One exemplary embodiment comprises a braking device. In an emergency, for example an electric power failure, the braking device is disposed to stop the movement of the slide. One braking device each may be arranged in one or more of the existing drive housings.

Preferably, the rotor is mounted to one axial end of the rotor hub. For example, it is possible to arrange a driving motor, as well as a braking device in one drive housing. In doing so, the braking device may axially engage at least partially into the mounting space between the rotor and the shaft axis. In doing so, the braking device is arranged preferably axially adjacent to the rotor hub.

In one advantageous exemplary embodiment the rotor hub has a hollow shaft that encloses the drive shaft. In the direction of rotation, i.e., the peripheral direction around the shaft axis, the hollow shaft may be connected to the drive shaft in a force-locking and/or form-locking manner. Spokes may extend from the hollow shaft, or a disk may extend essentially radially or obliquely with respect to the shaft axis, in which case the rotor is supported by the disk or the spokes.

In a preferred exemplary embodiment the drive shaft is rotatably supported at a first bearing point via a first bearing mechanism and is rotatable supported on a second bearing point via a second bearing mechanism. The two bearing points are arranged on axially opposite sides relative to the connecting rod bearing. The first bearing mechanism is arranged between a first bearing part and the drive shaft, and the second bearing mechanism is arranged between a second bearing part and the drive shaft.

Preferably, the rotor and the rotor hub of the at least one driving motor are not additionally supported. The rotatable support of the rotor and rotor hub occurs only via the first bearing mechanism and/or the second bearing mechanism.

Preferably, the shaft axis preferably extends in a depth direction, in which the transport of the workpiece to and from the press also takes place.

In one embodiment the press drive device does not extend beyond the outside contour of the press frame. The "outside contour" is understood to mean a smallest-possible parallel epiped that is located in the press frame. Due to this configuration, it is possible to achieve a compact design of the press drive device. In particular, it is possible to arrange the press drive device on or in the press frame, for example in the head part of a press. Furthermore, there results the advantage that a tool change is simplified because the region directly in front of or behind the press is easily accessible from the top; and a tool to be replaced, for example by means of a crane, can be deposited on the press table directly next to the press frame.

The friction losses of the press drive device are minimal. The drive shaft and the driving motor are rotatably supported at only two bearing points. The first bearing mechanism and/or the second bearing mechanism are preferably configured as roller bearings, and could also be configured as sliding bearings for presses displaying higher press forces or connecting rod forces. As a result of the fact that there is no gearing between the driving motor and the drive shaft, there are no energy losses due to transmission.

High torques can be implemented via the electric driving motor or torque motor. Due to the direct connection of the rotor to the drive shaft, high angular accelerations and decelerations of the drive shaft are possible. These are transmitted to the slide via the connecting rod and the preferably existing toggle lever linkage. Consequently, accelerations and declarations of the slide are accomplished at high rates. The press drive device or a press equipped therewith thus displays a high dynamic in addition to the high energy efficiency. In one exemplary embodiment the full rate of revolutions of the press drive device is achieved in less than 40 milliseconds. This is due to the fact that the press drive device displays, in addition to minimal friction, only minimal mass moments of inertia—also in proportion to the available torque.

Preferably, the first bearing mechanism forms a fixed bearing, and the second bearing forms a movable bearing. Axial expansions of the drive shaft thus do not lead to tensions in the press drive device. An axial migration of the drive shaft is prevented by the fixed bearing. If only one driving motor is connected to the drive shaft, the driving motor is preferably provided on the axial side of the connecting rod bearing, where the fixed bearing is provided. Additionally or alternatively, it is also possible to arrange the—or a further—driving motor on the axial side of the movable bearing.

In the preferred exemplary embodiment of the press drive device, the rotor is directly connected to the drive shaft. In particular, the rotor hub is seated directly on the drive shaft.

It is advantageous if the first bearing part having the first bearing point is a component of the first drive housing, and/or if the second bearing part having the second bearing point is a component of the second drive housing. In particular the first bearing point is provided on the inside wall of the first drive housing, and the second bearing point is provided on the inside wall of the second drive housing. There, the drive shaft is supported against the inside wall via the respective bearing mechanism. Considering this arrangement, the drive shaft is thus not supported on the press frame but only on the two drive housings.

Preferably, the drive shaft is supported only on the first bearing point via the first bearing mechanism and on the second bearing point via the second bearing mechanism. There are no additional bearing points for the rotatable support of the drive shaft or components of the press drive device that are connected in a rotationally fixed manner to the drive shaft.

A press in accordance with the invention may comprise one or more of the press drive devices described hereinabove. Each press drive device is allocated, in particular, one toggle lever linkage that is acted upon by the connecting rod of the press drive device. If the press comprises several press drive devices, these are not mechanically coupled to each other. Each press drive device used in the press is able to adjust the angle of rotation of the drive shaft and thus the position of the connecting rod or the toggle lever linkage—independently of the other press drive devices. The press drive devices are coordinated by a press control and coupled in a controlled manner, as it were.

Advantageous embodiments of the invention can be inferred from the dependent patent claims, as well as from the description. The invention will be explained in detail hereinafter with reference to the appended drawings. They show in

DETAILED DESCRIPTION

Figure 8:
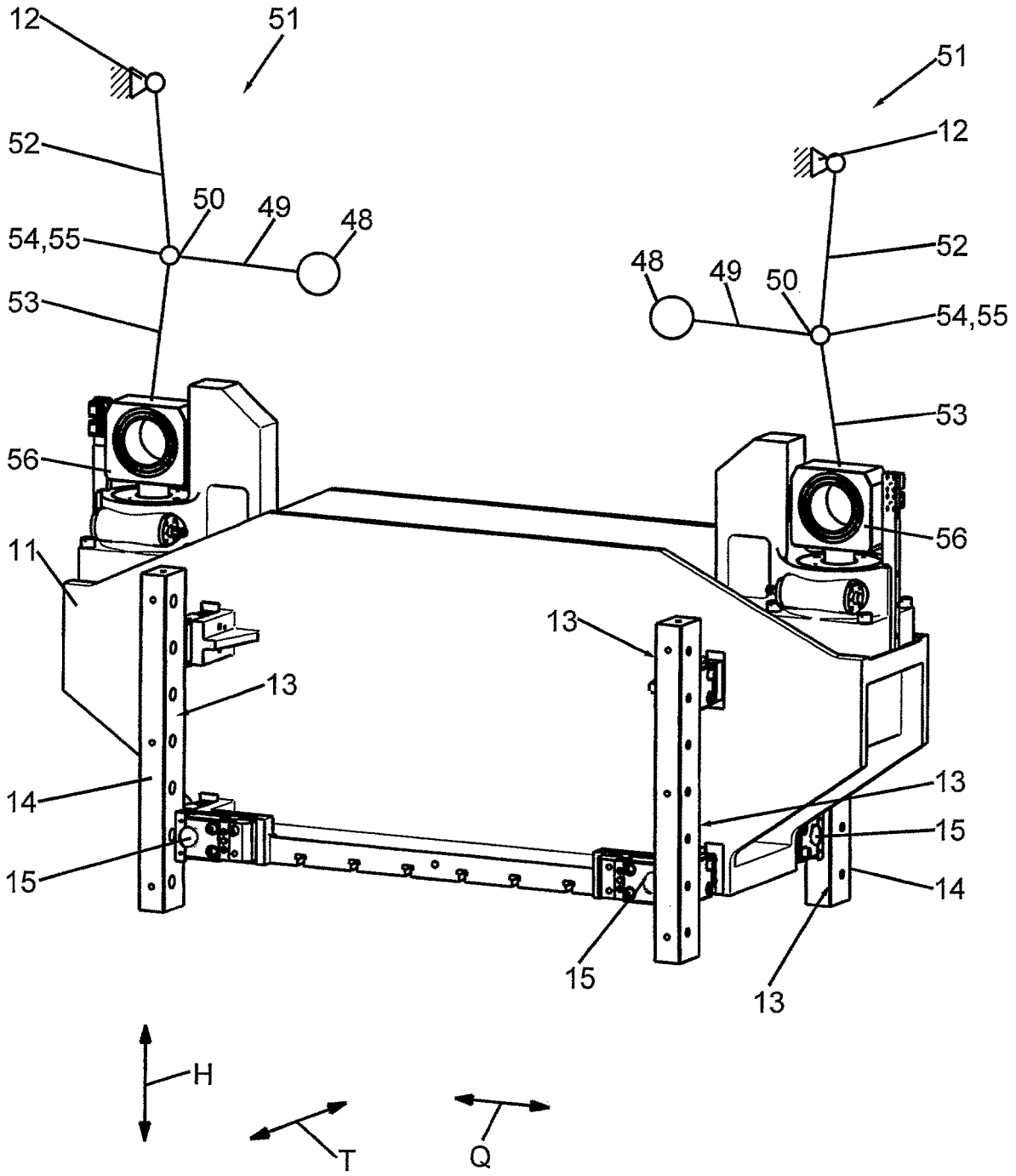
FIG. 8 a perspective view of a press slide and the slide guide of the press as in FIGS. 1 to 7, as well as a schematic representation of an exemplary embodiment of a toggle lever linkage of the press.

FIGS. 1 to 4 show various views of an exemplary embodiment of a press 10. The press 10 comprises a slide 11 that is supported so as to be movably guided in one stroke direction H, in particular in vertical direction, on a press frame 12. For guiding the slide 11, there are provided on the slide 11, in accordance with the example, rolls 15 that are in abutment with a respectively provided abutment surface 13 of a guide element 14 on the press frame side (FIG. 8).

The press frame 12 comprises a foot part 18 with a press table 19. A lower tool may be arranged on the press table 19. The lower tool may interact with an upper tool that is located on the slide 11. In the press 10 described herein, the lower tool is arranged so as to be immovable relative to the press frame 12. It is only the upper tool that can be moved relative to the press frame and the lower tool by means of the slide 11. The press 10 can be used for cutting and/or punching, stamping and/or drawing and/or bending and/or for other forming processes.

Furthermore, the press frame 12 has a head part 20. The slide 11 is located between the head part 20 and the foot part 18. In the exemplary embodiment illustrated here, the press 10 is embodied as a monoblock press, wherein the foot part 18 and the head part 20 of the press frame 12 are connected via two connecting parts or lateral stands to each other in a transverse direction Q at a distance from each other, said connecting parts respectively extending from the foot part 18 to the head part 20 in stroke direction H. In modification thereof, the press 10 could also be configured as a C-frame press or as a divided design, wherein the press elements (head piece, stand, press table) are suitably connected to each other.

A depth direction T is oriented at a right angle with respect to stroke direction H and with respect to transverse direction Q. Viewed in depth direction T, the press 10 has a front side (FIG. 2) and a rear side opposite the front side. In the press 10 illustrated here, the transport of a workpiece takes place from the front side or the rear side into the press 10, and out of the press 10 to the front side or to the rear side, respectively.

At least one and, in the exemplary embodiment described here, two press drive devices 21 are arranged in the head part 20. The at least one press drive device 21 is disposed for moving the slide 11 in stroke direction H.

Figure 5:
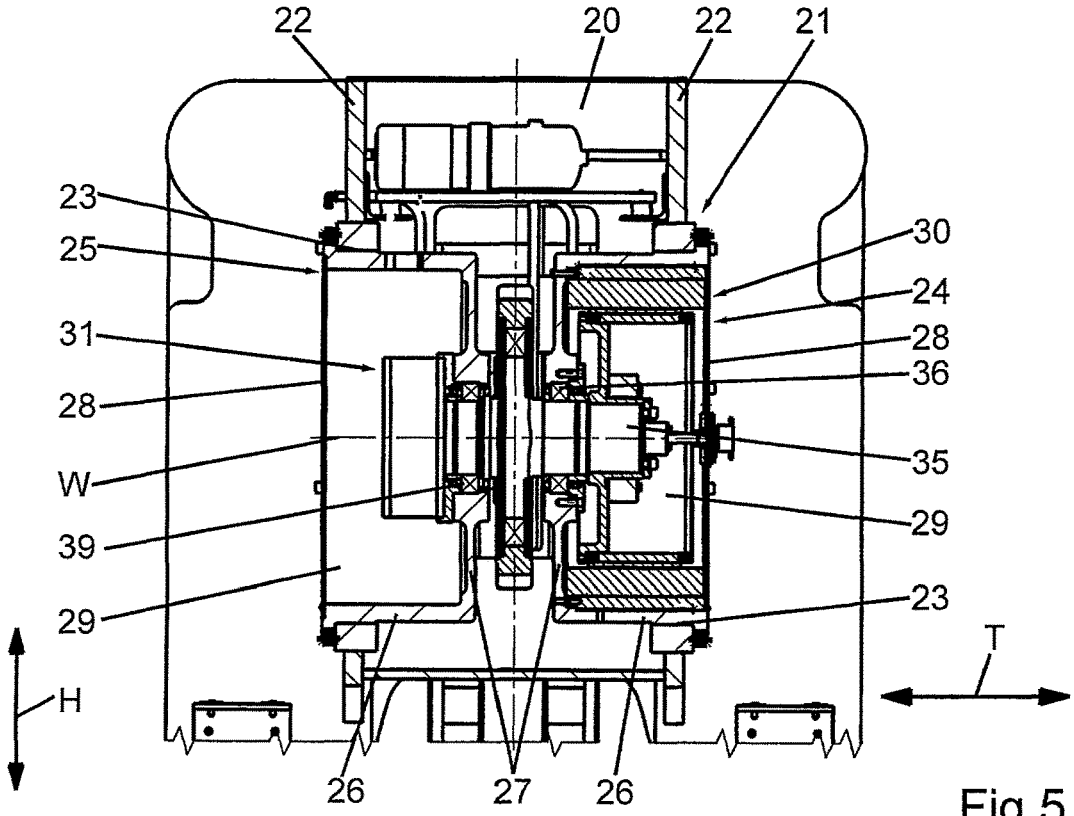
FIG. 5 a partial sectional representation of the press as in FIGS. 1 to 4, in a sectional view along intersection line V-V as in FIG. 2.

On the head part 20, the press frame 12 has two press frame plates 22 that are at a distance from each other in depth direction T. The press frame plates 22 extend in a plane that is defined by transverse direction Q and stroke direction H. The two press frame plates 22 comprise, for each press drive device 21, one circular receiving opening 23 (FIG. 5). The receiving openings 23 in the two press frame plates 22 for a joint press drive device 21 are arranged so as to be in alignment in depth direction T and coaxial about a shaft axis W of the respective press drive device 21.

Each press drive device 21 comprises a first drive housing 24 and a second drive housing 25. The first drive housing 24 is arranged in the one press frame plate 22 and the second drive housing 25 is arranged in the respectively other press frame plate 22, coaxially with respect to the same shaft axis W. The shaft axis W of each press drive device 21 extends in depth direction T.

Figure 7:
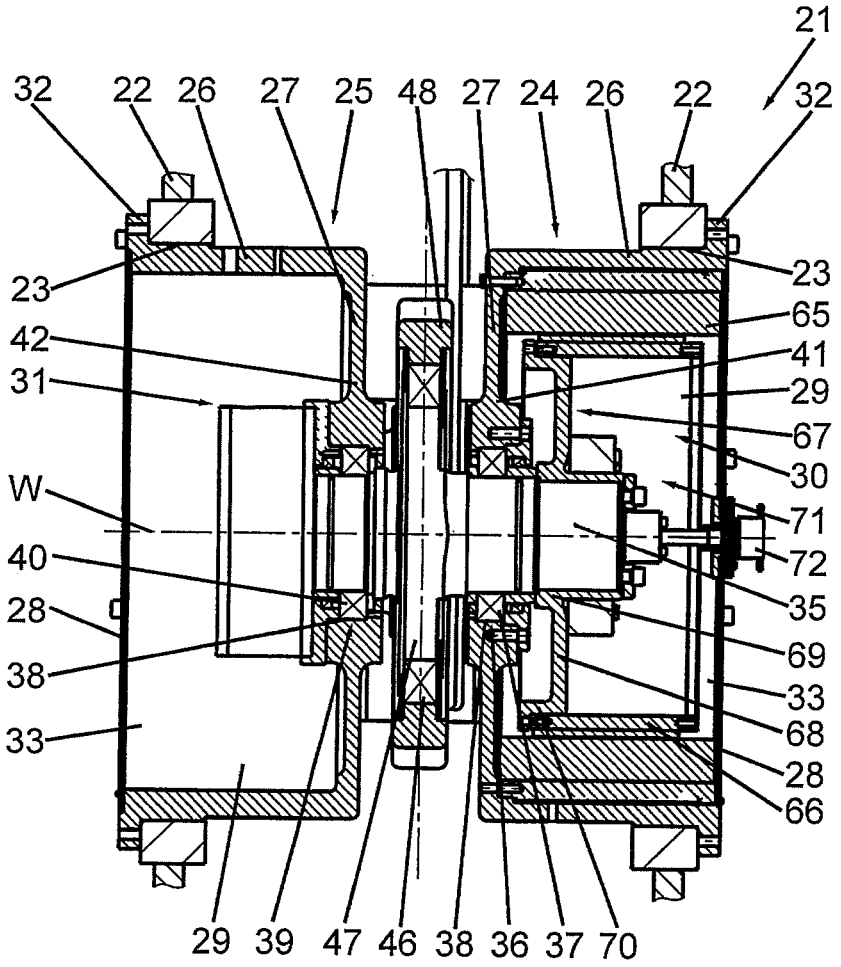
FIG. 7 a view of a detail of one of the two press drive devices with the two drive housings in the sectional view according to FIG. 5, along a shaft axis of a drive shaft of the press drive device.

Each drive housing 24, 25 has an annular peripheral wall 26 arranged coaxially with respect to the respective shaft axis W, as well as an inside wall 27. The inside wall 27 extends essentially radially with respect to the respective shaft axis W. The inside wall 27 of a respective drive housing 24, 25 is located on the axial side, at which the drive housing 24, 25 faces the respectively other drive housing 25 and 24. On the side axially opposite the inside wall 27, the respective drive housing 24, 25 has a housing opening 33 (FIG. 7) that is closed by a cover 28. Consequently, an essentially cylindrically contoured housing interior 29 is formed in each drive housing 24, 25. A driving motor 30 and/or a braking device 31 may be arranged in the housing interior 29.

The first drive housing 24, as well as the second drive housing 25, have—on the axial side opposite the inside wall 27—a mounting means for mounting the respective drive housing 24, 25 to the associate press frame plate 22. In accordance with the example, at least one mounting flange 32 is used as mounting means. In the exemplary embodiment illustrated here, the mounting flange 32 is configured as a ring flange and completely encloses the housing opening 33 of the respective drive housing 24, 25. The drive housings 24, 25 can be screwed to their associate press frame plates 22, respectively via holes in the mounting flange 32.

Each drive device 21 comprises a drive shaft 35. In accordance with the example, the drive shaft 35 is configured as an eccentric shaft and—in accordance with the example—could also be a crankshaft. The drive shaft 35 extends along the shaft axis W and is supported so as to be rotatable about the shaft axis W. A first bearing mechanism 37 is provided at a first bearing point 36 for supporting the drive shaft 35. The first bearing point 36 is formed in a cylindrical bearing recess 38 of the inside wall 27 of the first drive housing 24. The first bearing mechanism 37 is located between the bearing recess 38 and the drive shaft 35. Furthermore, the drive shaft 35 is supported by means of a second bearing mechanism 40 at a second bearing point 39 that is formed, for example, by a bearing recess 38 on the inside wall 27 of the second drive housing 25. The second bearing mechanism 40 is arranged between the bearing recess 38 and the drive shaft 35.

In accordance with the example, the drive shaft 35 is supported only via the two bearing mechanisms 37, 40 at the first bearing point 36 and the second bearing point 39, respectively. There are no additional bearing points.

In the exemplary embodiment described here, the inside walls 27 having the bearing recesses 38 thus form a first bearing part 41 for the first bearing point 36 and a second bearing part 42 for the second bearing point 39. In modification of this exemplary embodiment, the first bearing part 41 and/or the second bearing part 42 could also be an element of the machine frame.

At least one of the bearing points—in accordance with the example, the first bearing point 36—is configured as a fixed bearing in order to prevent an axial shifting of the drive shaft 35. The respectively other bearing point—in accordance with the example, the second bearing point 39—is configured as a movable bearing in order to prevent tensions and constraining forces in the press drive devices 21.

The drive shaft 35 has a connecting rod bearing 46 between the two bearing points 36, 39. The connecting rod bearing 46 is arranged so as to be eccentric with respect to shaft axis W. In accordance with the example, the connecting rod bearing 46 is seated on an eccentric part 47 of the drive shaft 35 arranged eccentrically with respect to shaft axis W.

In the exemplary embodiment described here, the two bearing mechanisms 37, 40 are roller bearings. In the exemplary embodiment, the connecting rod bearing 46 is likewise a roller bearing.

The drive shaft, in accordance with the example the eccentric part 47, is connected to the driving end 48 of a connecting rod 49 via the connecting rod bearing 46. The connecting rod 49 of a respective press drive device 21 extends—as a function of the position of the angle of rotation of the drive shaft 35—in approximately transverse direction Q or slightly obliquely with respect thereto. On the end opposite the driving end 48, the connecting rod 49 has a driven end 50.

The driven end 50 of the connecting rod 49 in the press 10 described here is coupled with an associate toggle lever linkage 51. It would also be possible to couple the driven end of the connecting rod 49 to the press slide 11—via an eccentric gear or also directly.

Each press drive device 21 is associated with a toggle lever linkage 51. The two toggle lever linkages 51 in accordance with the example are illustrated highly schematically in FIG. 8. The specific arrangement of a toggle lever linkage 51 in the press 10 can be inferred from FIG. 6. Each toggle lever linkage 51 comprises a first toggle lever 52 and a second toggle lever 53. The two toggle levers 52, 53 are linked to each other via a link joint 54—in accordance with the example a toggle link 55. Furthermore, the second toggle lever 53 is linked to a pressure point 56. The first toggle lever 52 is linked on its end opposite the toggle link 55 to the press frame 12.

Figure 12:
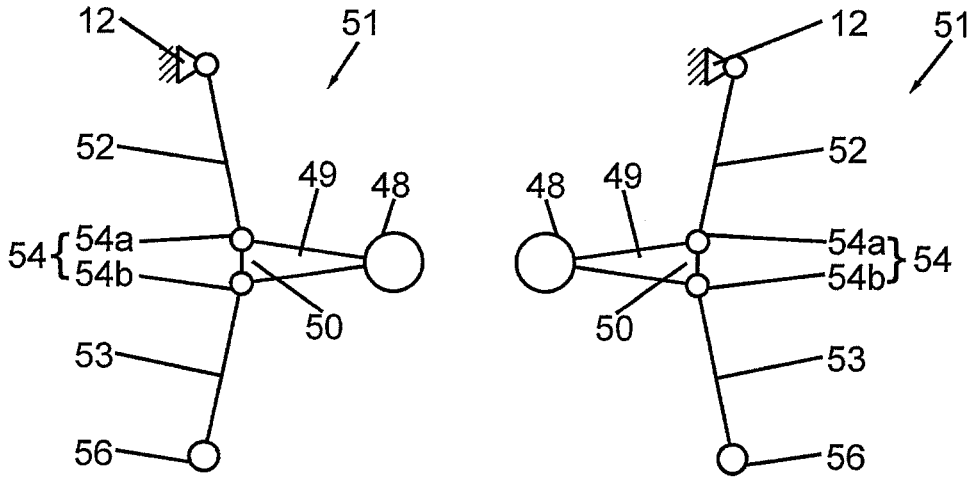
FIG. 12 schematic diagram of the principle of a modified exemplary embodiment of a toggle lever linkage of the press.

FIG. 12 shows a modified embodiment of the link joint 54. The connecting rod 49 has three joint points, i.e., one on the driving end 48 (as in FIG. 8), one joint point 54*a* for connection to the first toggle lever 52 and one joint point 54*b* for connection to the second toggle lever 53. Other than that, the toggle lever linkage 51 corresponds to the toggle lever linkage 51 of FIG. 8.

Figure 3:
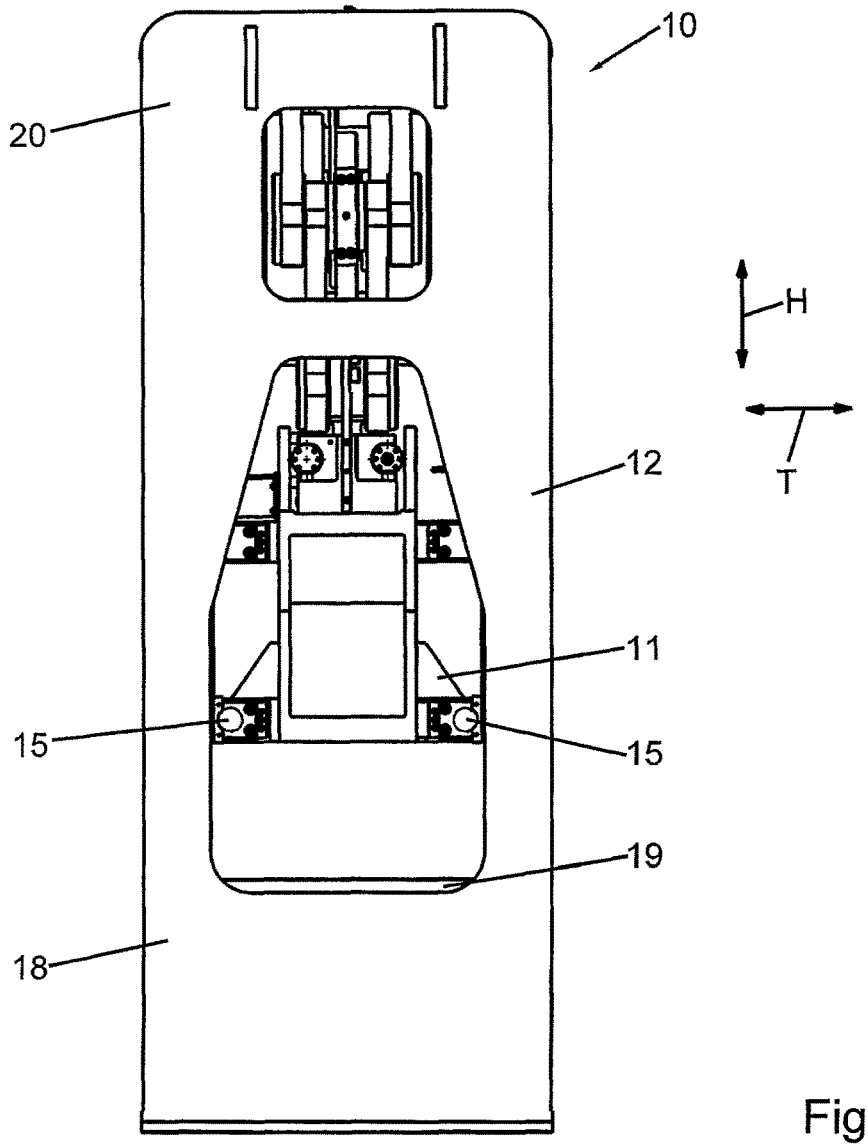
FIG. 3 a side view of the press as in FIGS. 1 and 2.
Figure 6:
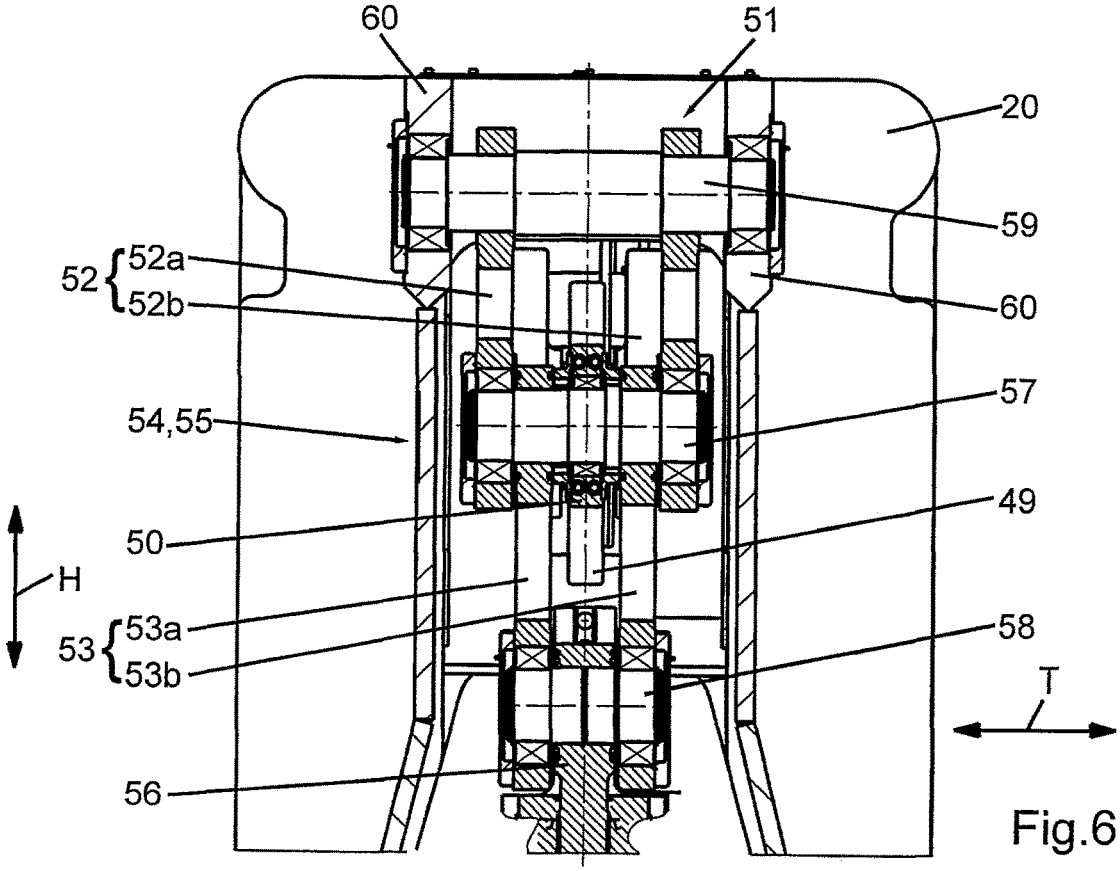
FIG. 6 a partial representation of the press as in FIGS. 1 to 5, in a sectional view along intersection line VI-VI as in FIG. 2.
Figure 13:
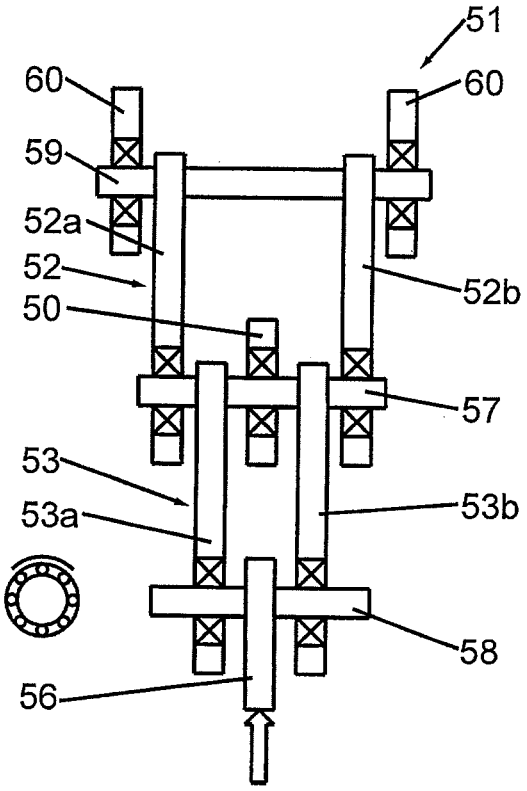
FIG. 13 a schematic diagram of the principle of a bearing mechanism for a toggle lever linkage.

As can be inferred from FIGS. 6 and 13 and in part also from FIG. 3, the toggle link 55 is formed by a toggle link pin 57, where the driven end 50 of the connecting rod 49 is supported. In accordance with the example, the second toggle lever 53 is formed by two toggle lever elements 53*a*, 53*b* that enclose the toggle link pin 57 on one end and are hinged on the other end to the respectively associate pressure point 56 of the slide 11 with the aid of a first bearing pin 58. The two toggle lever elements 53*a*, 53*b* are arranged in axial direction of the toggle link pin 57 on opposite sides of the driven end 50 of the connecting rod 49.

Corresponding to the second toggle lever 53, also the first toggle lever 52 is formed by two toggle lever elements 52*a*, 52*b*. The two toggle lever elements 52*a*, 52*b* are arranged on opposite sides of the toggle link pin 52, so that the driven end 50 of the connecting rod 49, as well as the ends of the two toggle lever elements 53*a*, 53*b* of the second toggle lever 53 associated with the toggle link 55, are located in between. Viewed in depth direction T, the distance between the two toggle lever elements 52*a*, 52*b* of the first toggle lever 52 is greater than the distance between the two toggle lever elements 53*a*, 53*b* of the second toggle lever 53. In modification of the illustrated exemplary embodiment, it is also possible to configure the driven end 50 of the connecting rod 49 in a bifurcated manner. The first toggle lever 52 and/or the second toggle lever 53 might also be embodied with only one toggle lever element 52*a* or 52*b* and 53*a* or 53*b*, respectively.

Figure 1:
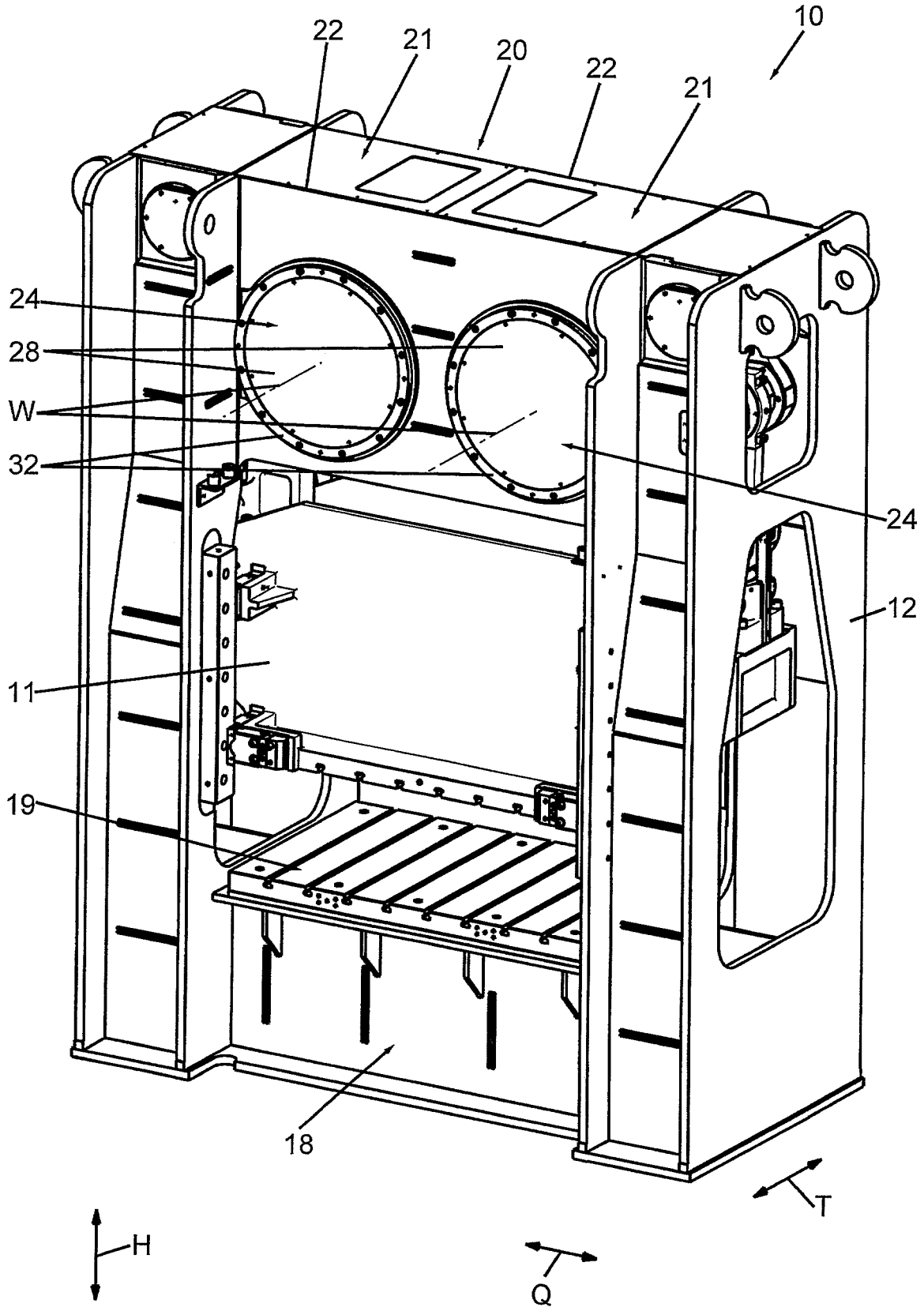
FIG. 1 a perspective view of an exemplary embodiment of a press comprising two press drive devices.
Figure 2:
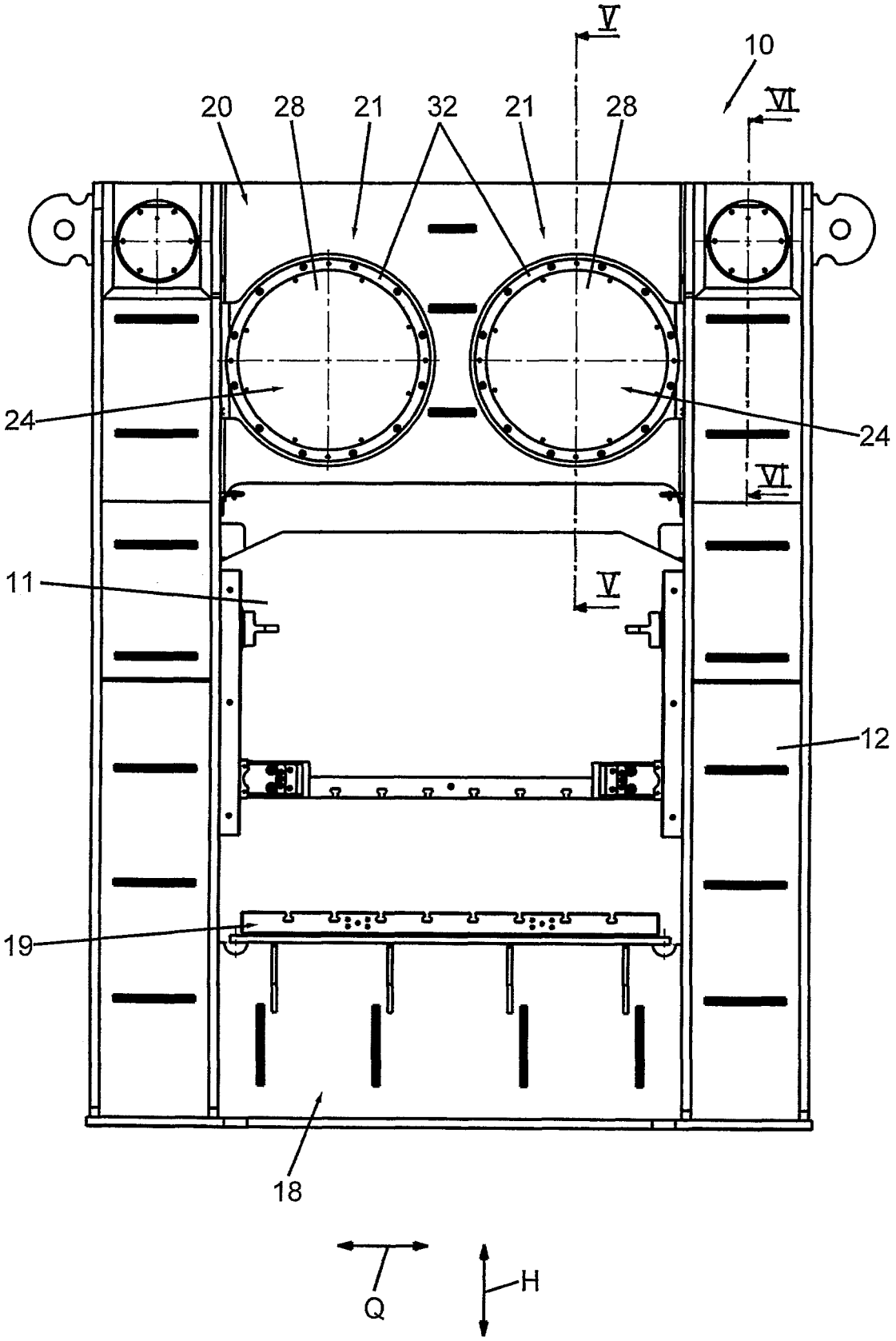
FIG. 2 a front view of the press as in FIG. 1.
Figure 4:
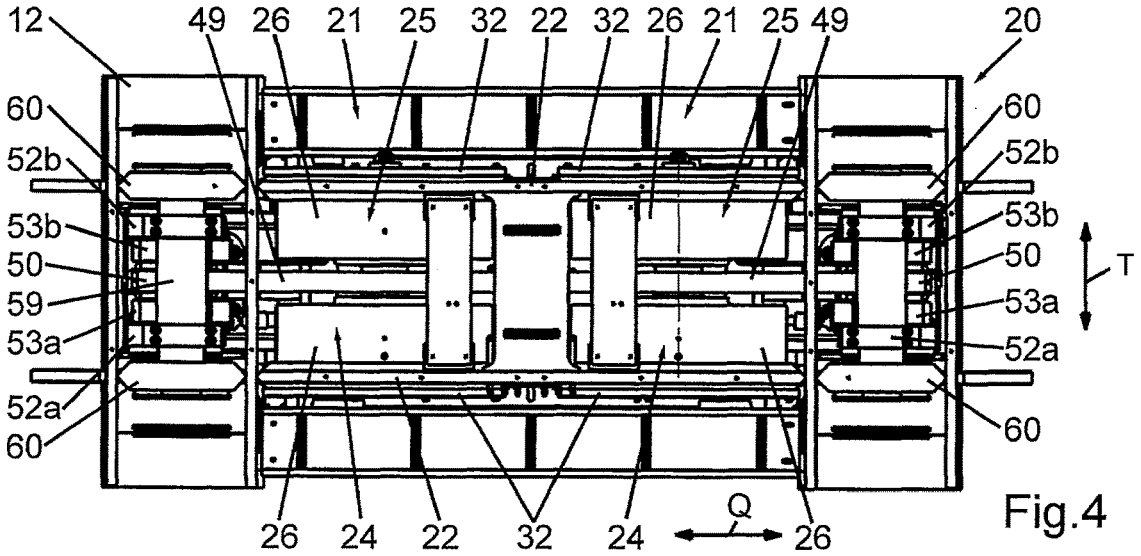
FIG. 4 a plan view of the press as in FIGS. 1 to 3.

On the end opposite the toggle link 55, the two toggle lever elements 52*a*, 52*b* of the first toggle lever 52 are supported in a hinged manner by the press frame 12 via a second bearing pin 59. According to the example, the second bearing pin 59 is supported on its two axial ends in a bearing recess of a cheek 60 of the press frame 12. In the exemplary embodiment, the two cheeks 60 supporting the second bearing pin 59 are at the same distance as the two press frame plates 22 in depth direction T (FIGS. 1 and 4).

As illustrated by FIGS. 6 and 13, the elements of the toggle lever linkage 51, said elements being rotatable relative to each other, are supported via a roller bearing. For example, the second bearing pin 59 is supported by the cheeks 60 on the press frame 12 via a roller bearing. The two toggle lever elements 52*a*, 52*b* of the first toggle lever 52 are seated on the second bearing pin 59 in a rotationally fixed manner and are rotatably supported on the second bearing pin 59 via one roller bearing, respectively. At the pressure point 56, the second bearing pin 59 is connected to the slide in a rotationally fixed manner.

In FIG. 13 it can be seen that a load is applied to the upper side of the roller bearings by introducing the press force at the pressure point 56 in stroke direction. In an alternative embodiment according to FIG. 14, this load application zone of the bearings is in the lower region. This is accomplished in that the bearings—different from the arrangement of FIG. 13—are arranged between the toggle lever elements 52*a*, 52*b* of the first toggle lever 52 and the second bearing pin 59, between the toggle lever elements 53*a*, 53*b* of the second toggle lever 53 and the toggle link pin 57, as well as between the pressure point 56 and the first bearing pin 58. The first bearing pin 58 is connected to the toggle lever elements 53*a*, 53*b* of the second toggle lever 53 in a rotationally fixed manner. The toggle link pin 57 is connected to the toggle lever elements 52*a*, 52*b* of the first toggle lever 52 in a rotationally fixed manner, and the second bearing pin 59 is seated in a rotationally fixed manner in the cheeks 60 of the press frame 12.

Figure 14:
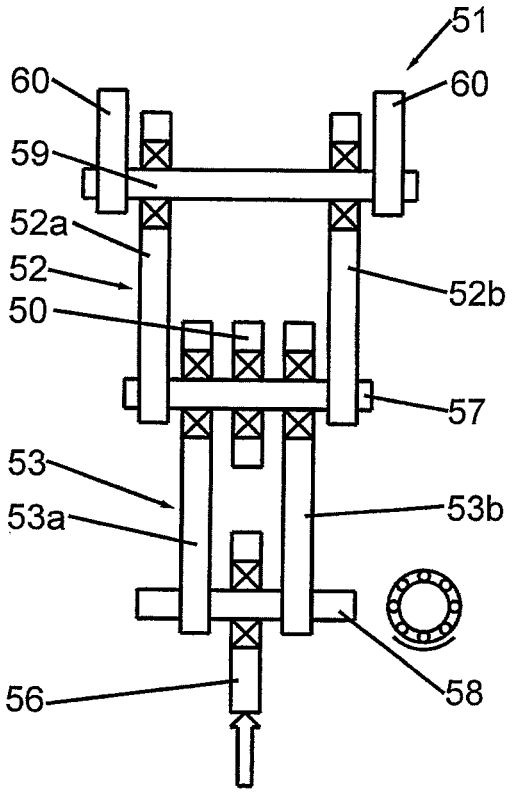
FIG. 14 a schematic diagram of the principle of another bearing mechanism for a toggle lever linkage.

Compared to the arrangement according to FIG. 13, the arrangement according to FIG. 14 features the advantage that all bearings are located within the outside contour of the press frame or the press body. This facilitates sealing the press body, in the event of oil or grease lubrication, in particular in the case of sliding bearings.

Instead of the roller bearings used for support in accordance with the example, it is possible—in principle—to also use other bearings such as, for example, sliding bearings. Sliding bearings may be advantageous if greater forces act on the specific mounting location of the bearing, which forces can be absorbed only by very expensive roller bearings.

In the exemplary embodiment the slide 11 of the press 10 has two pressure points 56 arranged at a distance from each other in transverse direction Q. The pressure points 56 are arranged along a straight line extending in transverse direction Q. The distance between the two pressure points 56 is greater than the dimension of the press table 19 in transverse direction Q. Therefore, the two pressure points 56 are located not above the press table 19 but, viewed in transverse direction Q, close to the two lateral stands of the press frame that connect the foot part 18 and the head part 20 to each other. As a result of this, a bending stress of the head part 20 does not occur, and the press stiffness is increased.

As explained, each press drive device 21 comprises at least one electric driving motor 30. The at least one driving motor 30 is arranged in the first drive housing 24 or in the second drive housing 25. It is also possible to arrange respectively one driving motor 30 in both drive housings 24, 25. In the exemplary embodiment according to FIGS. 1 to 8 described here, each press drive device 21 comprises one single driving motor 30.

In accordance with the example, the driving motor 30 is arranged in the first drive housing 24. The motor has a stator 65 arranged coaxially with respect to the shaft axis W. In accordance with the example, the stator 65 is mounted to the inside surface of the peripheral wall 26 facing the shaft axis W.

Radially with respect to the shaft axis W, there is arranged—within the stator 65 coaxially around the shaft axis W—a ring-shaped rotor 66. In the exemplary embodiment, the rotor 66 bears permanent magnets. The field coils are arranged in the stator 65. The driving motor 30 is preferably embodied as a servomotor or torque motor. Different from servomotors, the torque motor has a large number of pole pairs and is designed for lower rotational speeds and higher torques. Therefore, in accordance with the example, the diameter of the torque motor is clearly greater, compared to its axial design dimensions.

On its end associated with the inside wall 27, the rotor 66 of the driving motor 30 is mounted to a rotor hub 67. In accordance with the example, the rotor hub 67 comprises a disk 68 extending radially or obliquely with respect to the shaft axis W. The radially inner end of this disk 68 is connected to a hollow shaft 69 that is seated on the drive shaft 35. The hollow shaft 69 can be connected in the direction of rotation about the shaft axis W to the drive shaft 35 in a form-locking and/or force-locking manner. On the radially outer end opposite the hollow shaft 69, the rotor hub 67 has a holding part 70 to which the rotor 66 is mounted. In the exemplary embodiment, the holding part 70 has an annular section extending coaxially with respect to the shaft axis W, said annular section being coaxially enclosed by the associate axial end of the rotor 60.

It is also possible for several spokes—instead of the disk 68—to extend between the hollow shaft 69 and the holding part 70.

The rotor hub 67 is preferably made in one piece, without seams and joints. The rotor hub 67 and the rotor 66 mounted to it have the overall configuration of a rim. Radially within the rotor 66 and axially adjacent to the disk 68 or the rotor hub, there remains a mounting space or receiving space 71. In this receiving space 71, there is sufficient room in case a braking device 32 is to be installed in addition to a driving motor 30 in a drive housing.

Via the rotor hub 67, the rotor 66 is connected to the drive shaft 35 in a rotationally fixed manner. A rotation of the rotor 66 by a specified angle of rotation about the shaft axis W thus results in the rotation of the drive shaft 35 by the same angle of rotation. A step-up or step-down gear between the rotating motion of the rotor 66 and the rotating motion of the drive shaft 35 does not exist. The mechanical connection between the rotor 66 and the drive shaft 35 does not comprise gearing and is without play, in particular.

The rotor 66 and the rotor hub 67 are supported only via the bearing mechanisms 37, 40 that are disposed to support the drive shaft 35. Separate, additional motor bearings are not needed.

A sensor 72 is arranged on one drive housing 24, 25, in accordance with the example on the first drive housing 24. In accordance with the example, the sensor 72 is seated in extension of the drive shaft 35, whereby the shaft axis W extends through said sensor. The sensor housing is located outside the housing interior 29 and, in accordance with the example, may be arranged on the cover 28 closing the first drive housing 24. The sensor 72 is disposed to detect the position of rotation of the driving motor 30. The detection of the position of rotation may by with contact or contactless. Each driving motor 30 or each drive shaft 35 is preferably allocated at least one sensor 72.

The sensor 72 may also be used for detecting the position of the slide 11 in stroke direction H. In the present embodiment of the press 10 this is very easy, because the position of rotation of the rotor 66 of the driving motor 30 directly corresponds to the position of rotation of the drive shaft 35 (motor angle=press angle). Their position of rotation determines the position of the slide 11 in stroke direction H.

If several driving motors 30 are connected to one common drive shaft 35 (FIGS. 9-11), the position of rotation of both driving motors 30 is detected by one shared sensor 72. To do so, the driving motors 30 are mounted in corresponding positions of rotation.

As is obvious, in particular from FIGS. 1, 4, 5 and 7, the first drive housing 24, as well as the second drive housing 25, are located almost completely between the two press frame plates 22. Only the mounting flange 32, the cover 28, as well as a sensor 72 optionally arranged on the cover 28, are located outside the contour that is defined by the two machine plates 22. The driving motor 30 and/or the braking device 31 arranged inside the housing interior 29 are located completely in the space between the two outside surfaces of the press frame plates 22 that face away from each other.

In the exemplary embodiment according to FIGS. 1 to 8, the braking device 31 is arranged in the second drive housing 25. One brake part is rigidly connected to the second drive housing 25 and, in accordance with the example to the inside wall 27, while the other brake part is connected to the drive shaft 35 in a rotationally fixed manner. In accordance with the example, appropriate mounting means for the braking device 31, or their part that is fitted to the housing, are provided on the inside of the inside wall 27. In the event of an emergency situation, for example in the event of an electrical power failure of the press drive device 21, the braking device 31 is triggered and stops the rotary motion of the drive shaft 35 and thus the oscillating movement of the slide 11. Each drive device 21 comprises at least one braking device 31.

The press 10 does not have a hydraulic overload protection. The overload protection is performed by an electrical or electronic activation of the at least one electric driving motor 30 of each press drive device 21.

The electric driving motors 30 of different press drive devices 21 are not permanently mechanically coupled to each other. The coordinated rotation of the electrical driving motors 30 of different press drive devices 21 about the respectively associate shaft axis W is accomplished by the press control. Therefore, there is a coordination of the rotary motion of the driving motors 30 of different press drive devices 21 due to control or regulatory measures.

As a result of the fact that the press drive devices 21 are not permanently mechanically coupled, another position of the respective pressure point 56 in stroke direction H can be specified via each press drive device 21. In order to avoid damaging the guide of the slide 11, the guide allows the slide 11 at least one additional degree of freedom of movement in the movement in stroke direction H, i.e., as defined by depth direction T and transverse direction Q. In accordance with the example, the inclined position is a tilting position about an axis parallel to depth direction T.

If, in one modified exemplary embodiment, pressure points 56 are additionally arranged in depth direction T at a distance from each other, a tilt movement may additionally be allowed about an axis that is oriented parallel to transverse direction Q. In the exemplary embodiment illustrated here, the slide 11 is supported at twelve locations above respectively one roll 15 opposite an abutment surface 13 on the side of the press frame (FIG. 8). Four abutment surfaces 13 have either a normal vector in depth direction T, and four abutment surfaces have a normal vector in transverse direction Q. In stroke direction, the rolls 15 are arranged at two spaced apart height levels on slide 11. At the one height level—in accordance with the example the lower height level—one roll 15 is in abutment with each of the eight abutment surfaces. At the other height level—in accordance with the example the upper height level—respectively one roll 15 is in abutment with only the four abutment surfaces having a normal vector pointing in depth direction T. As a result of this, a tilting of the slide 11 about an axis parallel to depth direction T becomes possible. In the same manner, a tilting about an axis parallel to transverse direction Q could be realized alternatively if, at the other height level, e.g. at the upper height level, the rolls 15 abut against the four abutment surfaces 13 that have a normal vector pointing in transverse direction Q with one roll respectively. If the rolls 15 are arranged at only at one height level, a tilting of the slide 11 about the axes in two spatial direction T, Q is possible.

The press 10 comprises two not illustrated force sensors in order to detect the press force applied by the slide 11. The force sensors may be arranged at any point in the drive train between the driving motor and the slide 11. For example, a force sensor for the detection of the press force may be present on each toggle lever linkage 51. The sensor signal of the force sensor is output to the control of the press 10 and evaluated. In order to avoid an overload, it is detected—dependent on the actual position of rotation and thus dependent on the actual position of the slide 11, as well as dependent on the sensor signal of the force sensor—whether or not an overload and hence damage of the press 10, the tool or the workpiece is threatened. In this event, the at least one driving motor 30 can be energized or switched to generator mode in such a manner that a braking force counter the actual direction of rotation is generated and the slide movement is stopped. Also, such an overload function can be implemented by regulating or control measures, without the use of hydraulic overload devices.

If a press drive device 21 comprises several driving motors 30, this can increase the drive torque and/or the rated power path. Preferably, the existing driving motors 30 of a shared press drive device 21 are activated by one press control, for example via separate frequency converters. If, in a forming task, the torque of all driving motors 30 is not needed or if, during the slide movement, at least in one section of the movement profile the torque of all driving motors 30 is not needed, it is possible to operate one or more of the driving motors, for example, passively without power or in generator mode. It is also possible to activate the driving motors 30 in such a manner that, overall, the losses of all driving motors 30 are minimized. In doing so, the existing driving motors 30 are activated in such a manner that the required torque is provided by the driving motors 30 in such a manner that the highest-possible total degree of efficiency is the result. In order to have a greater variability, it is also possible to use driving motors 30 with different torque/power characteristics and/or different characteristic maps of efficiency.

In generator mode, it is possible, for example, to feed energy back into the energy storage in an electrical intermediate circuit. This energy can be used during the subsequent working stroke. As a result of this, the mains load can be reduced.

As a result of the fact that the driving motor 30 is coupled directly to the drive shaft 35 without transmission and due to the use of the roller bearings for supporting the connecting rod 49 or for supporting the toggle levers 52, 53 of the toggle lever linkage 51, the press 10 achieves high dynamics. The press slide 11 can be accelerated or decelerated at high rates. Furthermore, the press 10 operates at a very low noise level.

Depending on the forming task, the press slide 11 can be moved with any movement profile in stroke direction H. For example, the press slide 11 can be stopped in the bottom dead center. For an oscillating movement of the press slide 11, the at least one driving motor can reverse its direction of rotation in the upper dead center and in the bottom dead center of the slide movement and can thus be driven so as to oscillate within one rotary angle range. It is also possible to select the rotary angle range symmetrically or asymmetrically around the bottom dead center, so that—after each reversal of the direction of rotation of the at least one driving motor 30—the bottom dead center of the slide movement is passed. Furthermore, the at least one driving motor 30 can be driven—without reversal of the direction of rotation—so as to rotate about the shaft axis W. Consequently, a slide movement may occur according to the following principles:

- path-bound as in a conventional gyrating mass press, or
- force-bound as in a hydraulic press, or
- energy-bound as in a forging press comprising a spindle, or the hammer principle.

Figure 9:
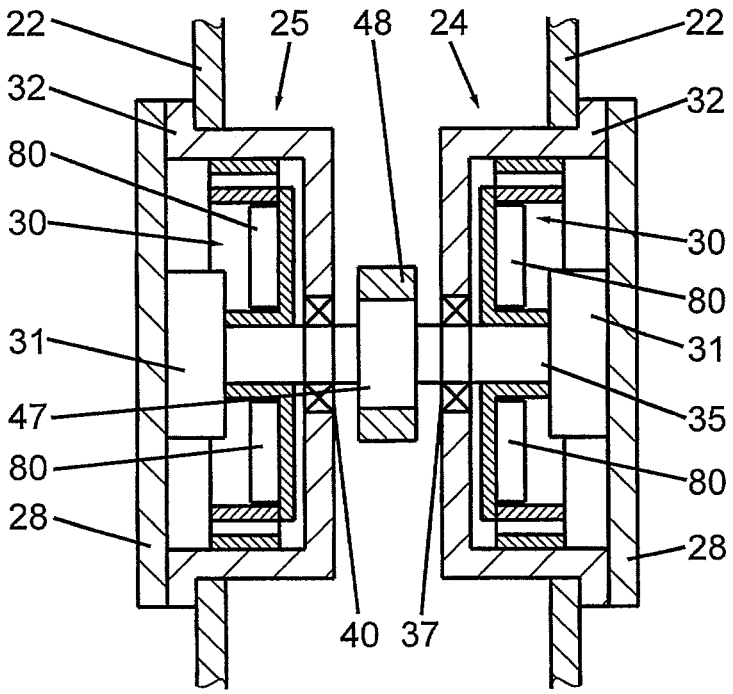
FIGS. 9-11 each, a block diagram of different configurations of a press drive device, each in a schematic sectional view along the shaft axis.
Figure 10:
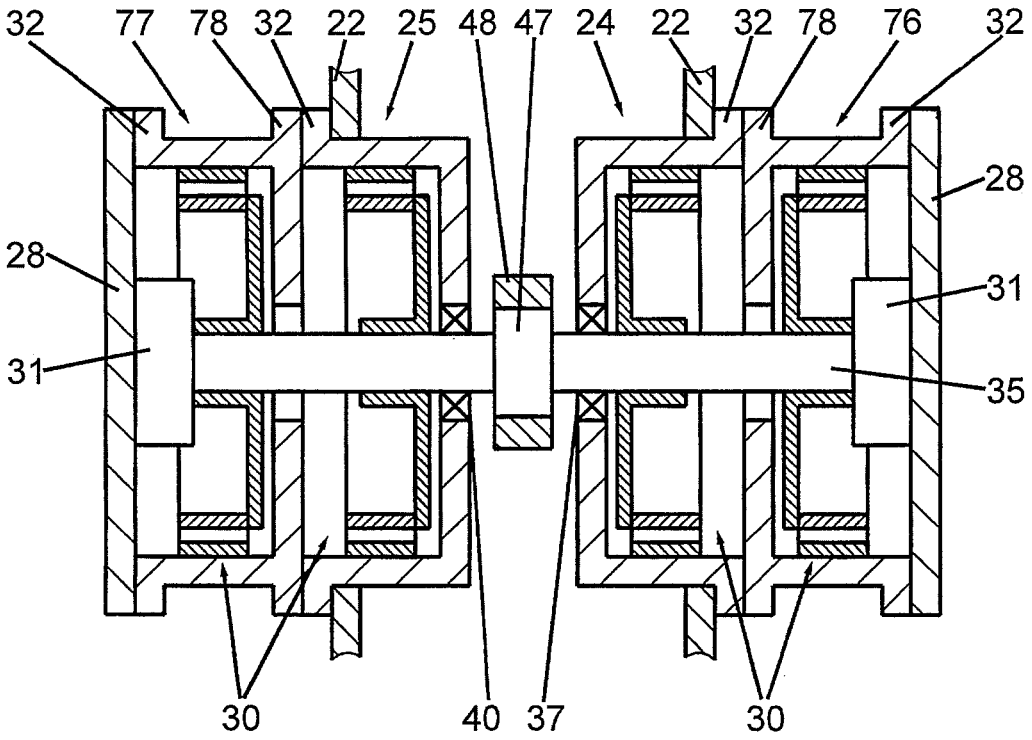
Figure 11:
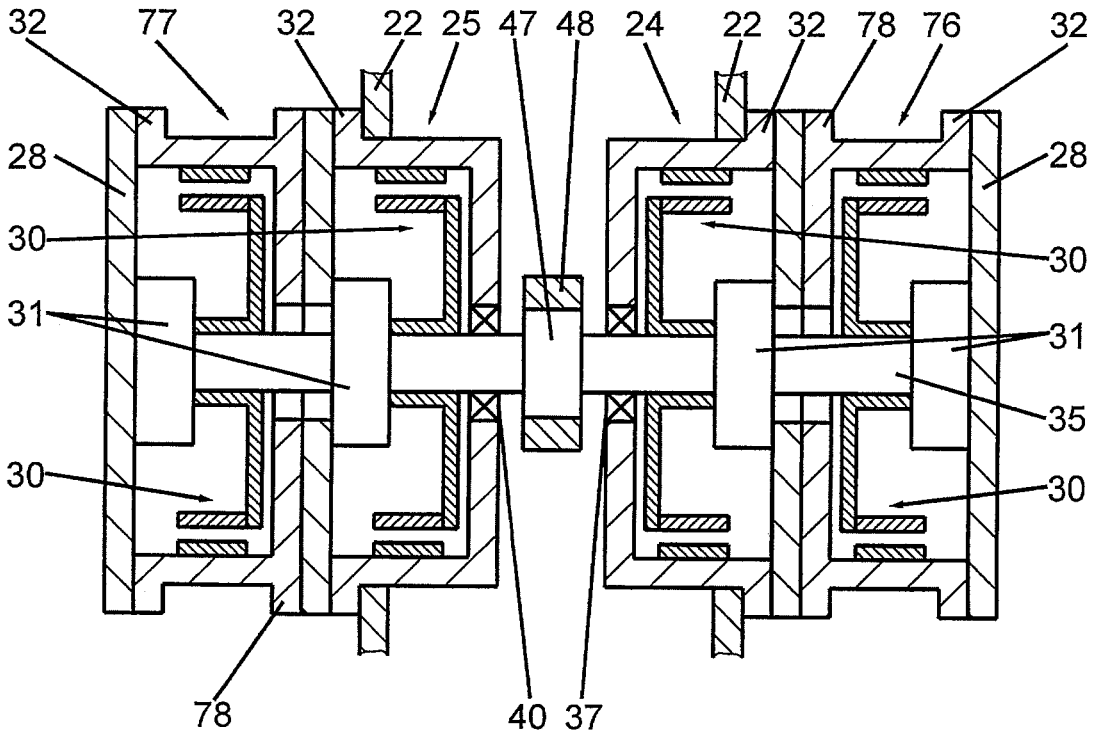

As has already been explained, it is possible to provide more than two drive housings 24, 25 and to arrange, in one or more of the drive housings, respectively one driving motor 30 and/or one braking device 31. FIGS. 9 to 11 show greatly schematized configuration examples. It is understood that also other configurations can be implemented.

In the exemplary embodiment illustrated in FIG. 9, a driving motor 30, as well as a braking device 31, are arranged in the first drive housing 24, as well as also in the second drive housing 25. In this embodiment, different from the previously explained exemplary embodiment, the part of the braking device 31 connected to the drive housing 24 or 25 is not connected to the inside wall but to the cover 28 of the drive housing.

In the exemplary embodiments according FIGS. 10 and 11, a third drive housing 76 is connected to the first drive housing 24, and a fourth drive housing 77 is connected to the second drive housing 25. The third and the fourth drive housings 76, 77 are arranged in extension of the shaft axis W and coaxially thereto. The third and the fourth drive housings 76, 77 are basically constructed exactly like the first drive housing 24 and the second drive housing 25. As is obvious from FIGS. 10 and 11, the drive shaft 35 is however only supported at the first bearing point 36 via the first bearing mechanism 37, and the second bearing point 39 via the second bearing mechanism 40. The drive shaft 35 extends through the covers 28 of the first and the second drive housings 24, 25, as well as through the respective inside wall 27 of the third and the fourth drive housings 76, 77.

Different from the first and the second drive housings 24, 25, the third drive housing 76 and the fourth drive housing 77 each has one connecting flange 78 on the axial side with the inside wall 27. Via this connecting flange 78, it is possible to connect the associate first drive housing 24 or the second drive housing 25.

Respectively one driving motor 30 and/or one braking device 31 can be also be arranged in the third drive housing 76 and in the fourth drive housing 77. Two configurations that are intended only as examples are illustrated by FIGS. 10 and 11. Referring to FIG. 11, one driving motor 30, as well as one braking device 31, are arranged in each drive housing 24, 25, 76, 77. As opposed to this, only two braking devices 31 exist in the exemplary embodiment according to FIG. 10, said braking devices being provided in the third drive housing 76 and the fourth drive housing 77.

Different from the exemplary embodiments according to FIGS. 9 to 11, asymmetrical arrangements with respect to the connecting rod bearing 46 are also conceivable, for example in such a manner that the driving motors 30 are located on the one axial side of the connecting rod bearing 46 and that the braking devices 31 are located on the respectively other axial side—corresponding to the exemplary embodiment as explained with reference to FIGS. 1 to 8. The number of drive housings may also be an odd number and, in principle, be provided in any desirable number greater than or equal to 2.

In all embodiments of the press drive device 21 it is possible, in principle, to also use an external rotor motor instead of the internal rotor motor in accordance with the example; however, this would be less advantageous, considering the compact arrangement in the drive housing.

In all embodiments of the press drive device 21, it is possible for the rotor and/or the rotor hub and/or other components connected in a rotationally fixed manner to the drive shaft 35 to act as a gyrating mass element 80 or as a gyrating mass (FIG. 9). The free mounting space available in the housing interior 29 can be used for providing such an additional gyrating mass.

The invention relates to a press drive device 21 for a press 10, comprising a connecting rod 49 that has a driving end 48 and a driven end 50. The driven end 50 is preferably coupled to a toggle joint 55 of a toggle mechanism 51. A drive shaft 35 is mounted so as to be rotatable about a shaft axis W and includes a connecting rod bearing 46 that is eccentric in relation to the shaft axis W. The driving end 48 of a connecting rod 49 is mounted on the connecting rod bearing 46. At least a first drive housing 24 and a second drive housing 25 are provided on axially opposite sides of the connecting rod bearing 46. The drive shaft 35 projects into both drive housings 24, 25. An electric driving motor 30, preferably a torque motor, is arranged in at least one of the drive housings 24, 25 and comprises a stator 65 which is connected in a rotationally fixed manner to a peripheral wall 26 of the drive housing 24, 25, said peripheral wall 26 being located coaxially around the shaft axis W. A rotor 66 supported by a rotor hub 67 is arranged radially within the stator 65. Mounting space inside which at least part of a braking device 31 can be arranged is provided between the shaft axis W and the rotor 66.

LIST OF REFERENCE SIGNS

10 Press
11 Slide
12 Press frame
13 Abutment surface
14 Guide element
15 Roll
18 Foot part
19 Press table
20 Head part
21 Press drive device
22 Press frame plate
23 Receiving opening
24 First drive housing
25 Second drive housing
26 Peripheral wall
27 Inside wall
28 Cover
29 Housing interior
30 Driving motor
31 Braking device
32 Mounting flange
33 Housing opening
35 Drive shaft
36 First bearing point
37 First bearing mechanism
38 Bearing recess
39 Second bearing point
40 Second bearing mechanism
41 First bearing part
42 Second bearing part
46 Connecting rod bearing
47 Eccentric part
48 Driving end
49 Connecting rod
50 Driven end
51 Toggle lever linkage
52 First toggle lever
**52*a*** Toggle lever element of the first toggle lever
**52*b*** Toggle lever element of the first toggle lever
53 Second toggle lever

53*a* Toggle lever element of the second toggle lever
53*b* Toggle lever element of the second toggle lever
54 Link joint
54*a* Joint point
54*b* Joint point
55 Toggle link
56 Pressure point
57 Toggle link pin
58 First bearing pin
59 Second bearing pin
60 Cheek
65 Stator
66 Rotor
67 Rotor hub
68 Disk
69 Hollow shaft
70 Holding part
71 Receiving space
72 Sensor
76 Third drive housing
77 Fourth drive housing
78 Connecting flange
80 Gyrating mass element
H Stroke direction
Q Transverse direction
T Depth direction
W Shaft axis

The invention claimed is:

1. A press drive device for a press, the press drive device comprising:

a connecting rod that has a driving end and a driven end, a drive shaft that can be rotated about a shaft axis and comprising a connecting rod bearing that is eccentrically arranged relative to the shaft axis and on which the driving end of the connecting rod is supported, at least one first drive housing having a first inside wall extending in a radial direction and one second drive housing having a second inside wall in a radial direction, wherein the first inside wall faces the second inside wall, wherein each of the at least one first drive housing and the second drive housing comprises a peripheral wall that is closed within itself defining a ring in peripheral direction around the shaft axis and/or extending coaxially relative to the shaft axis, a driving motor arranged in one or more of the at least one first drive housing and the second drive housing, said driving motor comprising a stator and a hollow cylindrical rotor, a rotor hub connected to the drive shaft in a rotationally fixed manner and to which the rotor is mounted with one axial end, wherein, radially between the shaft axis and the rotor and axially adjacent to the rotor hub, there is provided a mounting space inside one or both of the at least one first drive housing and inside the second drive housing that is disposed for installation of a braking device.

2. The press drive device according to claim 1, wherein the rotor is connected directly without gearing to the drive shaft.

3. The press drive device according to claim 1, wherein the rotor hub is a disk extending radially with respect to the shaft axis or comprises spokes extending radially with respect to the shaft axis.

4. The press drive device according to claim 1, wherein the rotor hub comprises a hollow shaft that encloses the drive shaft and is connected in a rotationally fixed manner to the drive shaft.

5. The press drive device according to claim 1, wherein the at least one first drive housing and the second drive housing each comprise a mounting flange configured to mount to a press frame that is arranged on the axial end of the peripheral wall on a side of the peripheral wall facing away from the connecting rod bearing.

6. The press drive device according to claim 1, wherein at least one braking device is provided in one or more of the first drive housing and the second drive housing.

7. The press drive device according to claim 1, further comprising the driving motor and a braking device disposed within a common housing comprising one of the first drive housing or the second drive housing, and wherein the braking device is arranged axially next to the rotor hub and engages at least partially in a mounting space between the rotor and the shaft axis.

8. The press drive device according to claim 1, having at least one of:

the first inside wall is connected to the peripheral wall of the at least one first drive housing, wherein the first inside wall is arranged on a side of the peripheral wall of the at least one first drive housing facing the connecting rod bearing, or the second inside wall is connected to the peripheral wall of the second drive housing, wherein the second inside wall is arranged on a side of the peripheral wall of the second drive housing facing the connecting rod bearing.

9. The press drive device according to claim 8, further comprising at least one further drive housing, which at least one further drive housing has a peripheral wall that is closed in peripheral direction within itself in the form of a ring around the shaft axis and/or extends coaxially with respect to the shaft axis, and has a connecting flange on an axial side facing the at least one first drive housing or the second drive housing.

10. The press drive device according to claim 1, further comprising a first bearing mechanism provided at a first bearing point, said first bearing mechanism supporting the drive shaft on a first bearing part, and a second bearing mechanism provided at a second bearing point, said second bearing mechanism supporting the drive shaft on a second bearing part, wherein the first bearing point and the second bearing point are arranged on axially different sides of the connecting rod bearing.

11. The press drive device according to claim 10, wherein the drive shaft, the rotor, and the rotor hub of the at least one driving motor (30) are supported only via the first bearing mechanism at the first bearing point and the second bearing mechanism at the second bearing point.

12. The press drive device according to claim 10, wherein the first bearing part with the first bearing point is a component of the at least one first drive housing and/or that the second bearing part with the second bearing point is a component of the second drive housing.

13. The press drive device according to claim 10, wherein one or both of the first bearing mechanism and the second bearing mechanism are configured as roller bearings.

14. The press drive device according to claim 10, wherein the first bearing mechanism forms a fixed bearing and the second bearing mechanism forms a movable bearing.

15. A press comprising:

a press frame which supports a slide in a manner so as to be movably guided in a stroke direction, at least one toggle lever linkage that comprises a first toggle lever and a second toggle lever, said levers being connected to each other by means of a link joint, wherein the first toggle lever is hinged to the press frame and the second toggle lever is hinged to a pressure point, and at least two press drive devices, each being movably coupled to the slide via respectively one toggle lever linkage, comprising:

a connecting rod that has a driving end and a driven end, a drive shaft that can be rotated about a shaft axis and comprising a connecting rod bearing that is eccentrically arranged relative to the shaft axis and on which the driving end of the connecting rod is supported, at least one first drive housing and at least one second drive housing, wherein individual ones of the at least one first drive housing and the at least one second drive housing comprises a peripheral wall that is closed within itself defining a ring in peripheral direction around the shaft axis and/or extending coaxially relative to the shaft axis, a driving motor arranged in one or more of the at least one first drive housing and the at least one second drive housing, said driving motor comprising a stator and a hollow cylindrical rotor, a rotor hub connected to the drive shaft in a rotationally fixed manner and to which the rotor is mounted with one axial end, wherein, radially between the shaft axis and the rotor and axially adjacent to the rotor hub within one or both of the at least one first drive housing and the at least one second drive housing, there is provided a mounting space that is disposed for installation of a braking device, wherein the driven end of the connecting rod is connected to the link joint.

16. The press according to claim 15, wherein one or both of the at least one first drive housing and the at least one second drive housing of one or more of the at least two press drive devices provides a housing interior in which the driving motor and/or a braking device are arranged, in which case the housing interior is arranged within an outside contour of the press frame.

* * * * *